US005697015A

United States Patent [19]

Ream et al.

[11] Patent Number: 5,697,015

[45] Date of Patent: Dec. 9, 1997

[54] ELECTROPHOTOGRAPHIC APPARATUS AND METHOD FOR INHIBITING CHARGE OVER-TRANSFER

[75] Inventors: Gregory Lawrence Ream; Pramod Kumar Sharma, both of Lexington, Ky.

[73] Assignee: Lexmark International, Inc., Lexington, Ky.

[21] Appl. No.: 655,011

[22] Filed: May 29, 1996

[51] Int. Cl.[6] ..... G03G 15/16

[52] U.S. Cl. ..... 399/66; 399/14; 399/314

[58] Field of Search ..... 355/271, 274, 355/203–208; 399/66, 297, 310, 313, 314, 14

[56] References Cited

U.S. PATENT DOCUMENTS

| | | | |
|---|---|---|---|
| 4,027,960 | 6/1977 | Ladrigan | 355/3 R |
| 4,468,113 | 8/1984 | Motohashi et al. | 355/14 TR |
| 4,506,971 | 3/1985 | Buell et al. | 355/3 TR |
| 5,010,370 | 4/1991 | Araya et al. | 355/274 |
| 5,012,293 | 4/1991 | Aldric | 355/274 |
| 5,036,360 | 7/1991 | Paxon et al. | 355/208 |
| 5,084,737 | 1/1992 | Hagen et al. | 355/274 |
| 5,153,653 | 10/1992 | Fuma et al. | 355/275 |
| 5,168,313 | 12/1992 | Hosaka et al. | 355/274 |
| 5,182,598 | 1/1993 | Hara et al. | 355/208 |
| 5,187,536 | 2/1993 | Hasegawa et al. | 355/327 |
| 5,196,885 | 3/1993 | Takeuchi et al. | 355/219 |
| 5,200,784 | 4/1993 | Kimura et al. | 355/274 |
| 5,233,395 | 8/1993 | Kohyama | 355/274 |
| 5,287,163 | 2/1994 | Miyashiro et al. | 355/326 R |
| 5,438,399 | 8/1995 | Asai | 355/273 |
| 5,452,063 | 9/1995 | Fletcher | 355/271 |
| 5,546,172 | 8/1996 | Seto | 355/274 |
| 5,568,228 | 10/1996 | Tombs | 355/208 |

FOREIGN PATENT DOCUMENTS

| | | | |
|---|---|---|---|
| 0 391 306 A2 | 2/1990 | European Pat. Off. | G03G 15/16 |

*Primary Examiner*—Arthur T. Grimley
*Assistant Examiner*—Quana Grainger
*Attorney, Agent, or Firm*—Ronald K. Aust

[57] ABSTRACT

Method and apparatus are provided for inhibiting toner transfer defects, and in particular, to inhibit over-transfer of electrical charge through a transfer medium to a toner after development of a latent image on a photoconductor in an electrophotographic imaging device. Toner transfer defects are inhibited near the leading edge of a print medium by a method which includes the step of providing a controlled ramped voltage output to a transfer member so as to provide a controlled flow of charge from the transfer member to the transfer medium during an initial application of electrical charge to a first region of the transfer medium adjacent a leading edge of the transfer medium. To inhibit intra-page toner transfer defects, the method of the invention includes the step of selectively activating a light source when the transfer medium is present in the nip region so as to partially discharge a portion of the photoconductor not containing a developed image when a servo voltage is below a servo threshold voltage during an image transfer.

16 Claims, 8 Drawing Sheets

ELECTROPHOTOGRAPHIC APPARATUS AND METHOD FOR INHIBITING CHARGE OVER-TRANSFER

FIELD OF THE INVENTION

The present invention relates generally to electrophotographic imaging devices, and more particularly, is directed to inhibiting the occurrence of transfer defects on a print medium resulting from charge over-transfer conditions in electrophotographic imaging devices.

BACKGROUND

In an electrophotographic (EP) printer a uniform surface charge is provided on a photoconductor, such as a rotating photoconductor (PC) drum, which then is selectively dissipated during a discharged area development (DAD) process by scanning the PC drum with a laser print head so as to form a latent image on the PC drum. The latent image is then developed during an image development process, in which electrically charged toner particles adhere to the discharged areas on the PC drum to form a toned image thereon. This toned and visible image is transferred from the PC drum to a print medium by a mechanically assisted electrostatic toner transfer process. During the transfer process, electrostatic charge opposite in polarity to that of the toner charge is deposited on the back side of the print medium by an electrically biased transfer roll. This charge on the print medium causes the toner to separate from the PC drum and a print is thus obtained on the print medium. The toned print medium then passes through a fusing station, in which the transferred toner is thermally bonded to the print medium. Thereafter, the imaging surface of the PC drum is cleaned to remove residual toner so as to prepare the PC drum surface for the formation of the next latent image.

The ability to consistently achieve high quality prints with an EP printer is highly dependent on achieving consistency in the electrostatic transfer process. It has been observed while operating an EP printer under high humidity conditions that the print quality near the top of the page, and/or the print quality intra-page at the start of a print region, such as a black patch, suffers from toner transfer defects which appear as a broken white band where toner should have been present on the printed page. These broken white bands are caused by incomplete separation (transfer) of toner from the PC drum to the print medium. Toner transfer defects are illustrated in FIGS. 1A and 2A.

FIG. 1A shows a prim medium 10 having a leading edge 12 and having a print region 14 where toner particles have been transferred during the toner transfer process. Print region 14 includes a transfer defect region 16 formed near leading edge 12 and adjacent proper transfer region 18. Transfer defect region 16 is caused by an over-transfer of electrical charge through-print-medium 10 during the transfer process and results in the broken white band.

FIG. 2A shows a print medium 30 having a leading edge 32 and having a plurality of print regions 34 (identified individually as 34A–34C) formed well down the page from leading edge 32 during intra-page printing. Print regions 34 are regions on print medium 30 where toner particles were transferred during the toner transfer process, and include transfer defect regions 36 (individually identified as 36A–36C) and proper transfer (black patch) regions 38 (identified individually as 38A–38C). As shown, transfer defect regions 36 are formed near a leading portion of their respective print region 34 and adjacent a respective proper transfer region 38.

Therefore, a need exists for an improved EP apparatus and method directed to inhibiting toner transfer defects.

SUMMARY OF THE INVENTION

The present invention is directed to EP printer apparatus and method for inhibiting toner transfer defects, and in particular, is directed to apparatus and method for inhibiting over-transfer of electrical charge through a transfer medium to a toner after development of a latent image on a photoconductor in an electrophotographic imaging device.

A method of the invention includes the step of providing a controlled ramped voltage output to a transfer member so as to provide a controlled flow of charge from the transfer member to the transfer medium during an initial application of electrical charge to a first region of the transfer medium adjacent a leading edge of the transfer medium.

Preferably, the step of providing a controlled ramped voltage output includes providing a stepped voltage increase from a first predetermined voltage to a second predetermined voltage. The first predetermined voltage corresponds to an inter-page voltage which is applied to the transfer member when the transfer medium has not yet entered a nip region between the photoconductor and the transfer member. The second predetermined voltage corresponds to a media present voltage to be applied to the transfer member when a leading edge of the transfer medium is adjacent the nip region between the photoconductor and the transfer member. The first predetermined voltage and the second predetermined voltage are determined based upon a measured voltage corresponding to a predetermined current flow between the photoconductor and the transfer member when the transfer medium has not yet entered a nip region between the photoconductor and the transfer member.

To inhibit intra-page toner transfer defects, the method of the invention includes the steps of measuring a servo voltage corresponding to a predetermined current flow between the photoconductor and the transfer member when the transfer medium is not present in a nip region between the photoconductor and the transfer member; selecting a servo threshold voltage corresponding to a voltage level below which an over-transfer of the electrical charge through the transfer medium to the toner occurs; and selectively activating a light source when the transfer medium is present in the nip region so as to partially discharge a portion of the photoconductor when the servo voltage is below the servo threshold voltage during an image transfer period.

Other features and advantages of the invention may be determined from the drawings and detailed description of the invention that follows.

DETAILED DESCRIPTION OF PREFERRED EMBODIMENTS

Figure 1A:
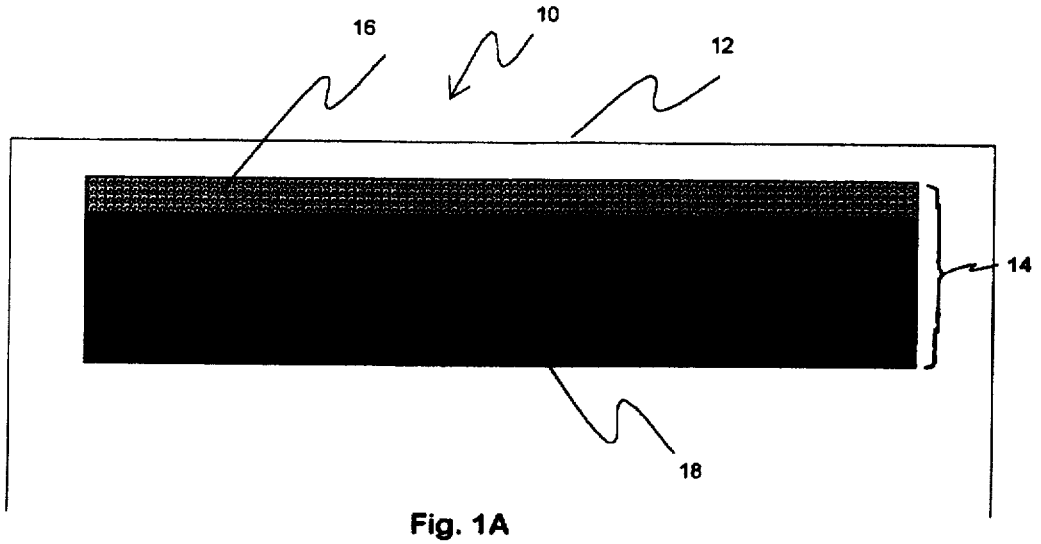
FIG. 1A illustrates toner transfer defects occurring at the leading edge of a printed page.
Figure 2A:
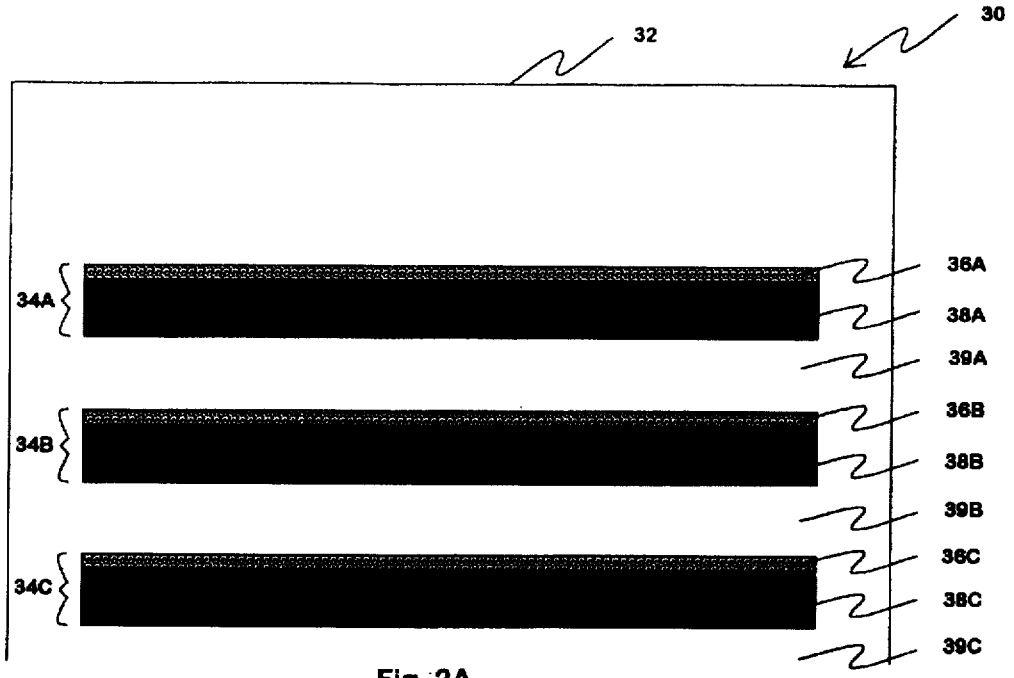
FIG. 2A illustrates intra-page toner transfer defects occurring at the top of black bands within the print area of a printed page.

It has been determined that the toner transfer defect region 16 shown in FIG. 1A and the toner transfer defect regions 36A–36C shown in FIG. 2A were due to excess charge flow through the print medium, which affects the charge carded by the toner particles. Hereinafter, this excess charge flow condition will be referred to as a "charge over-transfer condition", or simply "charge over-transfer." It has further been determined that charge over-transfer conditions are most prevalent where the EP primer is operating under high humidity conditions, such as for example, at 78 degrees Fahrenheit with 80% relative humidity.

Figure 1B:
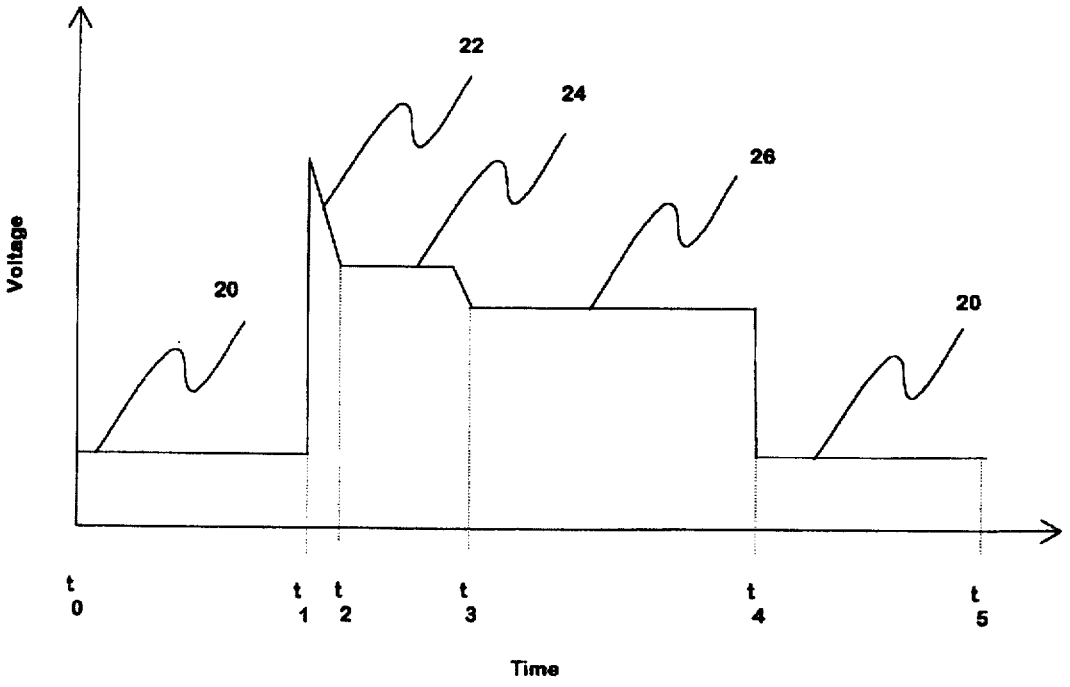
FIG. 1B graphically depicts the applied transfer roll voltage which resulted in the printed page of FIG. 1A.

FIG. 1B graphically illustrates the voltage profile of the applied transfer roll voltage-versus-time which resulted in the toner transfer defect condition depicted in FIG. 1A. Referring to FIG. 1B, an inter-page (IP) voltage is a voltage which is applied to the shaft of the transfer roll when no print medium is present in the nip region between the PC drum and the transfer roll, and a through-print-medium (TPM) voltage represents a voltage present when a print medium is present in the nip region. In the absence of print medium 10 from the nip region (period $t_0$ to $t_1$), the voltage applied to the transfer roll shaft remains at IP level 20. When medium 10 enters in the transfer region ($t_1$ to $t_2$) the transfer voltage is increased to TPM level 22, wherein the initial transfer voltage turn on to the transfer roll results in a voltage overshoot, which in turn results in the charge over-transfer/toner transfer defect region 16 of FIG. 1A. Voltage level 24 (at $t_2$ to $t_3$) is a TPM voltage level associated with the proper transfer (black patch) region 18 and voltage level 26 (at $t_3$–$t_4$) is a TPM voltage associated with the white areas on print medium 10 down the page from the black patch region 18. Immediately prior to print medium 10 clearing the nip region, the voltage at the shaft of the transfer roll reduces to IP level 20 ($t_4$ to $t_5$).

Figure 2B:
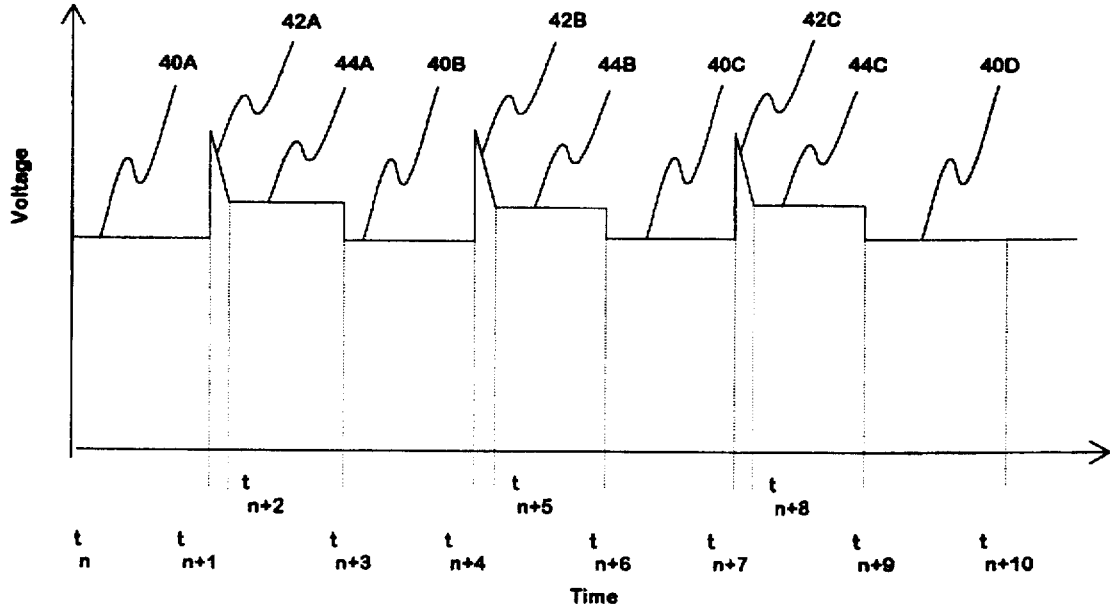
FIG. 2B graphically depicts the applied transfer roll voltage which resulted in the printed page of FIG. 2A.

FIG. 2B graphically illustrates the voltage profile of the applied transfer roll voltage-versus-time associated with the intra-page toner transfer defect conditions depicted in FIG. 2A, and following an initial transfer voltage mm on (not shown). During intra-page printing, the voltage difference between image and non-image areas on the PC drum causes the power supply supplying power to the transfer roll to enter and come out of current limit (time periods $t_{n+1}$ to $t_{n+2}$, $t_{n+4}$ to $t_{n+5}$, and $t_{n+7}$ to $t_{n+8}$) and an over-transfer of electrical charge occurs which results in the defect regions 36A, 36B, 36C of print regions 34A, 34B, 34C, respectively, as depicted in FIG. 2A. Referring to FIG. 2B, TPM voltage 40A is applied at time $t_n$ to the shaft of the transfer roller when print medium 30 has advanced into the nip region between the PC drum and the transfer roll. The print medium 30 continues through the nip region for the period $t_n$ to $t_{n+1}$ with the voltage applied to the transfer roll remaining at the TPM voltage 40A. At time $t_{n+}$, the intra-page transfer process begins for region 34A, wherein the transition from white to black results in a voltage overshoot ($t_{n+1}$ to $t_{n+2}$) which in turn results in the charge over-transfer/toner transfer defect region 36A of FIG. 2A. Voltage level 44A (at $t_{n+2}$ to $t_{n+3}$) is a TPM voltage level associated with the proper transfer (black patch) region 38A and voltage level 40B (at $t_{n+3}$ to $t_{n+4}$) is a TPM voltage level associated with the white area 39A on print medium 30 adjacent and down the page from black patch region 38A. This pattern is shown being repeated at times $t_{n+4}$ to $t_{n+7}$ and times $t_{n+7}$ to $t_{n+10}$, with voltage levels 42B, 44B, and 40C of FIG. 2B corresponding to regions 36B, 38B, and 39B, respectively, of FIG. 2A, and voltage levels 42C, 44C, and 40D of FIG. 2B corresponding to regions 36C, 38C, and 39C, respectively, of FIG. 2A.

Figure 3:
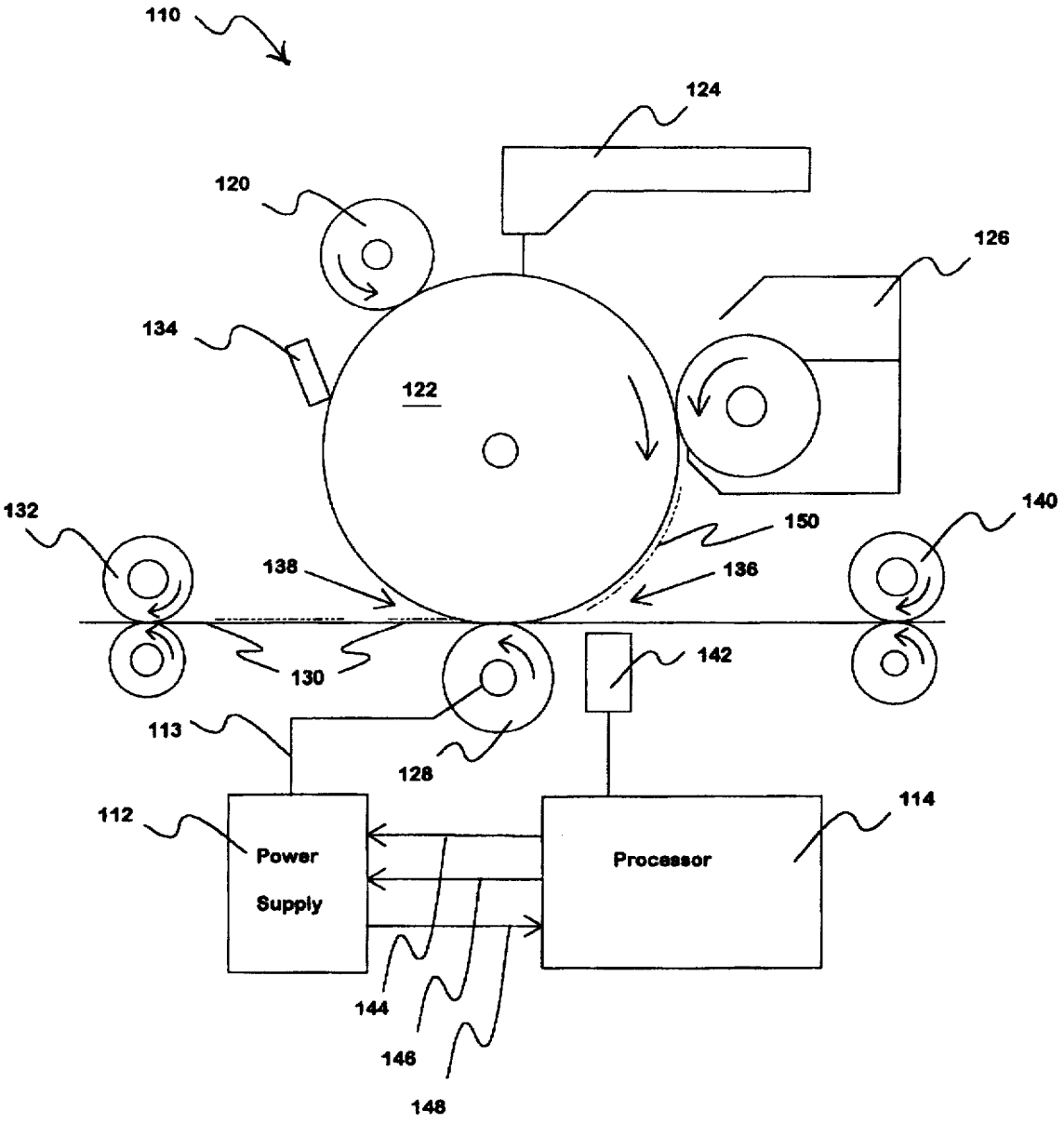
FIG. 3 is a diagrammatic illustration of an electrophotographic (EP) imaging apparatus embodying the present invention.

FIG. 3 illustrates an EP printer 110 embodying the present invention, which includes apparatus and method for inhibiting toner transfer defects resulting from charge over-transfer conditions. In EP printer 110, a charge roll 120 applies a uniform electrical charge to the surface of a rotating photoconductor 122. A "latent image" is then formed on the photoconductor 122 by scanning a laser print head 124 across the charged photoconductor 122 to dissipate charge at the image areas of the photoconductor 122. As the latent image is rotated past a toner developing station 126, which includes a toner cartridge, electrically charged toner particles adhere to the latent image areas on the photoconductor 122, thus forming a toned image 150 on the photoconductor 122. Print media moved by feed rollers 140 is introduced into a nip region 136 (sometimes also referred to as a transfer roll to photoconductor nip 136) coincident with the arrival of toned image 150 on photoconductor 122. The toned image 150 is then transferred to the print medium 130 by mechanically assisted electrostatic transfer.

Electrostatic charge opposite in polarity to that of the toner charge is conveyed to the print medium 130 by an electrically biased transfer roll 128 driven by high voltage power supply (HVPS) 112. The oppositely charged print medium 130 causes the toner to separate from the photoconductor 122 and adhere to the front side of the print medium 130. The toned image on the print medium 130 next passes through a fusing station 132, which thermally bonds the toned image to the print medium 130. The photoconductor 122 rotates through a cleaning station 134 after the transfer step so that a new image can be formed upon it. This process is substantially the same for EP copiers, except for the absence of a print head and development of toner into charged areas of the photoconductor.

Preferably, the transfer roll power supply 112 comprises a voltage-regulated high-voltage power supply with maximum steady-state output current limited to either 8 μA or 16 μA. Output voltage level is determined by a pulse-width modulated (PWM) logic input 144 from engine processor 114. The power supply current limit is selected by a binary logic input 146 from engine processor 114. A single binary output 148 of power supply 112 is used to indicate to engine processor 114 an output voltage of less than 0 volts or output current greater than 8 μA. Binary output 148 can serve this dual purpose since the output current is not greater than 8 μA when the output voltage is less than 0 volts, except under error conditions. Also, binary output 148 is used for calibration of power supply 112 and to dynamically determine the transfer-member load.

Maximum transfer current requirements in the range of 8–16 μA are typical of mono-component electrophotographic systems in the process speed range of 4 to 15 cm per second. Output voltage compliance must span a range from +200 volts to +4700 volts during print to accommodate the range of print medium and the variation in medium plus transfer member resistivity as a function of environment. A higher voltage compliance range, such as +400 volts to +9400 volts, would allow use of a more resistive transfer member and lessen the occurrence of over-transfer, but would add to the expense of the power supply and lead to other transfer problems such as toner disturbances as a result of rapid discharge of the print medium 130 in post-transfer nip 138.

Transfer currents may reach the steady-state current limit of 8 μA or 16 μA under conditions of high humidity. The current limit which is selected is determined from servo voltage, process speed, and medium type. This steady-state current limit prevents over-transfer under many conditions; it is normally active only when the resistivity of the transfer member and print medium are low as is characteristic of humid environments.

The transient response of the transfer power supply is critical to transfer performance. Voltage overshoot in response to a change in voltage at the output can result in transient currents delivered to the transfer member which exceed the selected steady-state current limit. Transient voltage overshoots may result from, for example, a transition from a lower voltage output to a higher voltage output in response to an increase in the pulse-width modulation input or a change in voltage on the image-bearing member associated with the developed image which causes the supply to change from a steady-state current-limit mode (in which the output voltage is lower than that set by an input pulse-width modulation) and return to a voltage-regulated mode. These transient voltage overshoots are especially significant when transfer voltages are low as is characteristic of humid environments. The resulting charge over-transfer can result in the appearance of white bands in the developed and transferred image.

Some transfer rolls, such as Part No. 1328348 available from Lexmark International, Inc., are sensitive to environmental temperature and humidity. This sensitivity is used advantageously in a closed loop transfer servo system within the printer as an indicator of the condition of the print medium. Other information on media type is available from operator input to the printer describing media type, such as "normal paper," "rough paper," or "transparency." This media information is used in conjunction with the transfer servo measurement of transfer roll resistance by the processor 114 to set the through-print-medium (TPM) transfer voltage during print and a corresponding current limit.

The Lexmark® transfer roll has a coating resistivity that is lower in resistivity than the underlying foam core. This coating resistivity increases during the life of the transfer roll. A new transfer roll with a low resistance coating is lower in resistance and more sensitive to over-transfer problems in comparison to a used roll.

Figure 4:
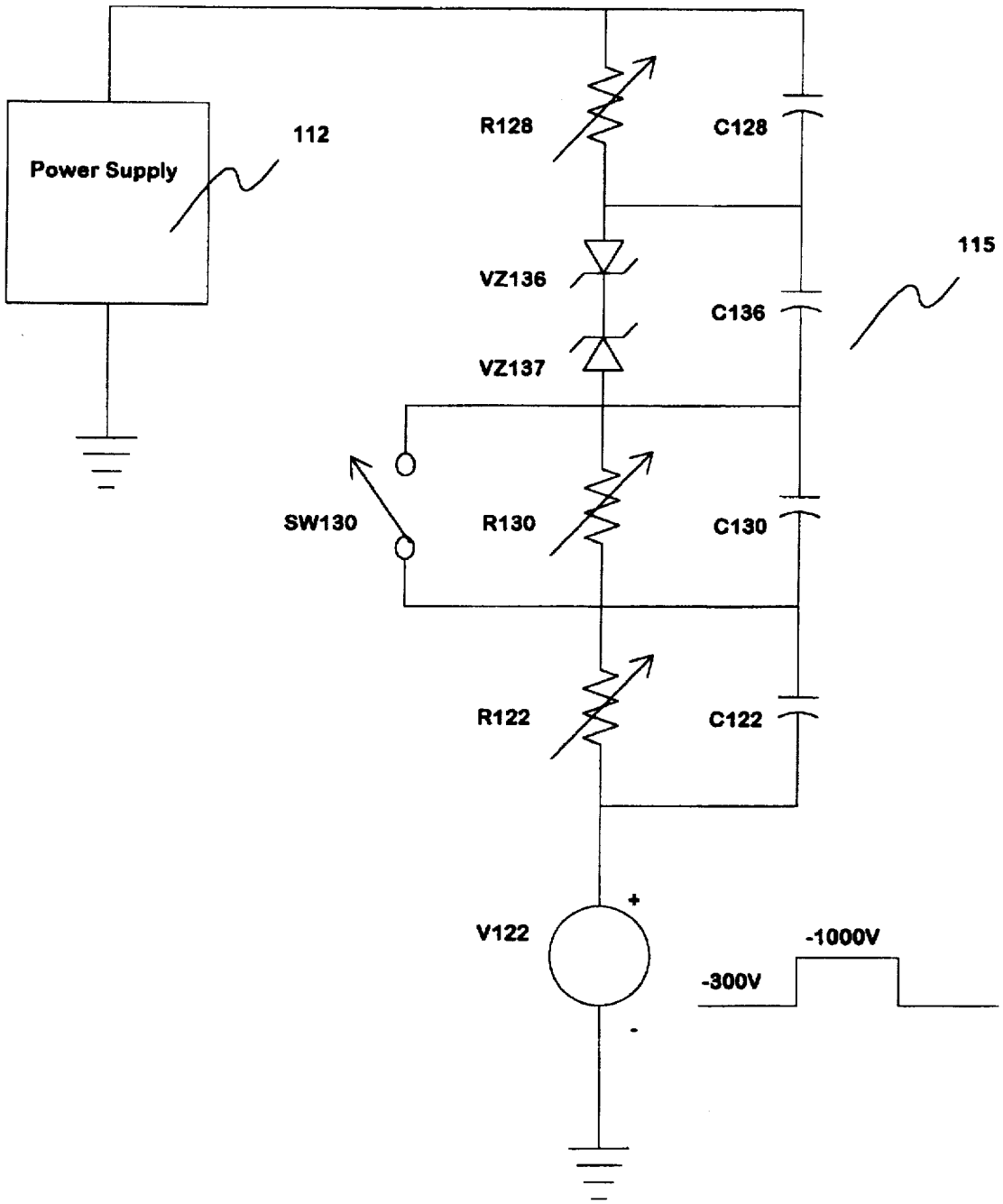
FIG. 4 is a schematic model representing the transfer components of an EP system as electrical circuit elements.

FIG. 4 shows an electrical circuit model of the transfer high-voltage power supply load. The model includes the expected range of resistivities and typical capacitance values for transfer roll, an air gap, print medium, and photoconductor. Electrical component numerical designations correspond to the physical component numerical designations previously described in FIG. 3. With reference to FIG. 4, the transfer high voltage power supply 112 drives the series load 115 which includes circuit elements R128, C128, VZ136, VZ137, C136, SW130, R130, C130, R122, C122.

Series load 115 includes a parallel circuit including a variable resistor R128 and a capacitor C128 which is an electrical representation of the humidity-sensitive transfer roll 128. Variable resistor R128 ranges in value from about 4 megohms to about 400 megohms. The 4 megohm resistance occurs at humid environments and the 400 megohm resistance occurs at dry environments. Capacitor C128 has a typical value of about 22 picofarads.

Series load 115 further includes a second parallel circuit which includes series back-to-back zener diodes VZ136 and VZ137, which are in parallel with capacitor C136. This second parallel circuit represents the electrical characteristics associated with the transfer roll to print medium or transfer roll to PC drum air gap. Zener diodes VZ136, 137 have zener voltages of 480 volts. The 480 volt drop occurs due to the need to create ions via air breakdown when current flows from the transfer roll to an insulative surface (print medium or PC drum ). Capacitor C136 has a typical value of 160 picofarads.

Series load 115 further includes a third parallel circuit which includes variable resistor 130, capacitor 130 and switch SW130. This third parallel circuit represents the electrical characteristics in nip region 136, depending on the presence or absence of a print medium, as further described below. Variable resistor R130, ranging in value from about 1 megohms to about 100 megohms, is in parallel with capacitor C130, which has a typical value of about 380 picofarads, and are in turn in parallel with switch SW130. When switch SW130 is open, this third parallel circuit represents, for example, the print medium characteristic for an 8 ½ inch width sheet of 20# paper. The 1 megohm resistance occurs in high humidity environments and the 100 megohm resistance occurs in dry environments or with duplexed pages. When SW130 is closed, no print medium is present in the transfer to photoconductor nip region 136.

Still further, series load 115 includes a fourth parallel circuit which includes a variable resistor R122, ranging in value from 25 to 85 megohms, in parallel with a capacitor C122, which has a typical value of 870 picofarads. This fourth parallel circuit represents the load of photoconductor 122. Resistor R122 is required to account for the charging current which flows to a rotating capacitive load. The range of resistance of resistor R122 is attributable to a range of process speeds, rather than temperature or humidity effects on photoconductor 122.

Voltage source V 122 represents the sum of the PC drum core potential and charge stored in the PC drum capacitance. The nominal charged level of photoconductor 122 corresponding to non-image or "white" areas is −1000 volts; the nominal discharged level of photoconductor 122 corresponding to image or "black" areas is −300 volts. Intermediate voltage levels occur during print and transfer servo operations.

The humidity sensitivity of transfer roll 128 and print medium 130 (circuit elements R128 and R130) results in a wide range of load resistance for power supply 112. Under humid conditions, in particular, the low resistance of the transfer roll 128 and print medium 130 cause voltage changes at either power supply 112 or photoconductor 122 to result in changes in current that are large in comparison to the desired 8 μA to 16 μA typical transfer current. In addition, the series/parallel capacitance of the load couples transient currents from photoconductor 122 to power supply 112.

The invention controls these transient currents so as to inhibit the voltage overshoot at the power supply output (see FIGS. 1B and 2B, voltage levels 22 and 42A–42C) which occur in the absence of the invention. As a result, the invention inhibits the charge over-transfer condition which would result in toner transfer defects (see FIGS. 1A and 2A, regions 16 and 36A–36C) in the toned image transferred to the print medium in the absence of the invention.

In the following paragraphs, a preferred embodiment of the invention is described in the sequence of recognizing the humid conditions characteristic of charge over-transfer, implementing a solution for charge over-transfer at the leading edge of a page, and implementing a solution for charge over-transfer within a page.

For optimal transfer of toner from photoconductor 122 to print medium 130, the voltage applied to transfer roll 128 should be maintained at a voltage that will induce a consistent flow of charge from transfer roll 128 to print medium 130 and photoconductor 122. Because of the temperature and humidity sensitivity of transfer roll 128 and print medium 130, a closed-loop control system is used to determine the print voltage by means of a servo process. The servo process removes much of the variation in transfer associated with changes in roll resistivity and medium properties which are a function of humidity, temperature, and component variation. Here, the voltage level applied to transfer roll 128 is adjusted until the rate of charge flow from transfer roll 128 to an oppositely charged photoconductor 122 reaches a predetermined reference current. This process, controlled by printer processor 114, ramps the transfer high-voltage power supply output 113 from a voltage less than 0 volts to a voltage level that produces a transfer roll current equal to a predetermined reference current. This reference current is preferably 8 μA in the present embodiment. Typically, a transfer servo operation is performed on a periodic basis every ten minutes of printing operation and for each print job.

Figure 5:
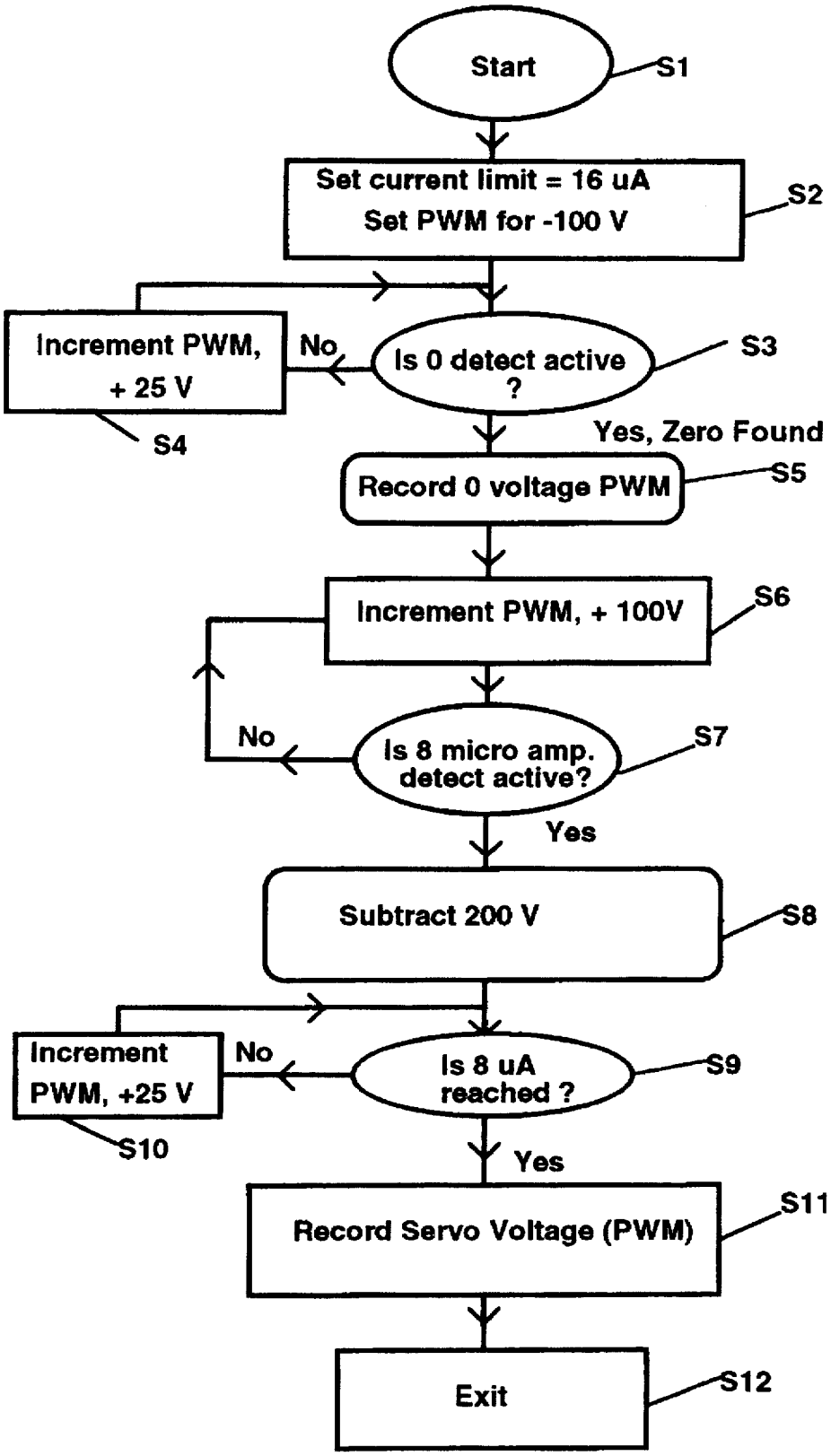
FIG. 5 is a flow chart describing the process used to determine a transfer servo voltage related to the electrical impedance of the transfer components.

FIG. 5 shows the flow chart implemented in processor code to determine the transfer servo voltage. Step S1 in FIG. 5 is the entry point for transfer servo voltage determination. In step S2 the transfer power supply current limit is set to 16 μA via processor binary output 146 and the initial voltage output is set to −100 volts via processor PWM output 144. The 16 μA current limit enables the supply to produce sufficient current to reach an 8 μA reference current comparison point; the −100 volt PWM is sufficiently low that, within manufacturing variation, all power supplies produce a voltage less than zero volts in response to this PWM. Steps S3, S4 and S5 calibrate the power supply by determining the actual PWM value corresponding to a zero volt output. On the 1st pass through step S3, the power supply output is normally less than zero volts resulting in a "no" response; zero detect is not active. This signal is conveyed to the processor via binary input line 148 from power supply 112. In this case, in step S4, the PWM is increased corresponding to an increase in power supply output voltage of +25 volts. Steps S3 and S4 are repeated until a "yes" response is obtained indicating that power supply output 113 is greater than or equal to zero. In step S5, the first PWM value that produced a power supply output voltage greater than zero is recorded as a reference point relating processor PWM to power supply output voltage with an accuracy of 25 volts. Step S6–S11 are related to determining the transfer servo voltage. Step S6 begins the transfer servo process to determine the PWM and corresponding voltage that delivers an 8 μA current flow from the power supply to the transfer member and associated load. In step S6, power supply output 113 is increased by a PWM increment corresponding to +100V. The binary output line 148 from power supply 112 to processor 114 is then tested in step S7 to see if the output current is greater than or equal to 8 μA. If not, power supply output 113 is increased again by +100 volts in step S6 and the test is repeated. If yes, the PWM is decreased corresponding to subtracting 200 volts from power supply output 113. In steps S9 and S10, the servo process is then repeated using finer increments of +25 volts to determine the PWM and corresponding voltage output which produce a current flow greater than or equal to 8 μA. Here, the binary output line 148 from power supply 112 to processor 114 is tested in step S9 to see if the output current is greater than or equal to 8 μA. If not, the PWM is incremented and the power supply output is increased by +25 volts in step S10. The test is then repeated in step S9. If yes, the transfer servo PWM is recorded in step S11 corresponding to the power supply 8 μA transfer servo voltage, and the servo process is concluded at step S12.

No print medium is present between transfer roll 128 and photoconductor 122 during the transfer servo process. Low servo voltages are indicative of low transfer roll resistance and are characteristic of high humidity. High servo voltages are indicative of high transfer roll resistance and are characteristic of a dry environment.

The transfer servo voltage is used to calculate both an inter-page (IP) voltage applied to transfer roll 128 when transfer medium 130 is absent from the nip 136 and a through-print medium (TPM) voltage to be applied when transfer medium 130 is present within the nip. The inter-page voltage is set to a fraction of the servo voltage to provide a small positive current from transfer roll 128 to photoconductor 122 to prevent negative toner from leaving photoconductor 122 for transfer roll 128 between printed pages. The through-print-medium voltage is set using the transfer servo voltage in addition to other information about print medium 130 entered by the printer operator and information available to processor 114, such as process speed and simplex or duplex (1st side or 2nd side) printing. The TPM voltage thus includes information about the print medium. In terms of the circuit model shown in FIG. 4, values of circuit elements R130 and C130 are estimated based on the results of the transfer roll servo operation, indicative of humidity, and other aposteriori information about the medium. The TPM voltage is greater than the servo voltage for most medium types.

Both the servo voltage and the through print-medium voltage levels contain information about the environment and medium which can be used to set thresholds below which over-transfer problems are likely to occur. The transfer servo voltage is indicative of environment; the through-print-medium voltage is indicative of environment and medium properties.

To prevent charge over-transfer at the leading edge of the print medium 130 the through print-medium voltage is compared to a print threshold voltage (PTV). When the TPM voltage is greater than the print threshold voltage, voltage overshoot, excessive current flow, and charge over-transfer are not a problem, and voids will not be produced in print near the leading edge of the image transferred from photoconductor 122 to the print medium 130.

When the TPM voltage falls below the print threshold voltage PTV, however, the printing system is susceptible to charge over-transfer conditions. To prevent charge over-transfer under these conditions, processor 114 controls power supply 112 to prevent transfer voltage overshoot by increasing transfer voltage in a stepwise fashion when image transfer commences. Preferably, power supply 112 is PWM controlled by processor 114 to increase the voltage output 113 in incremental steps corresponding to +100 volts each so that transfer voltage is increased one step every 30 milliseconds during the inter-page to through-print-medium voltage transition at the leading edge of a page. Alternatively, larger or smaller steps of lesser or greater duration may be employed to provide a ramped transfer voltage; but +100 volt steps of 30 milliseconds duration each have been found to provide a sufficiently rapid increase in the transfer voltage without creating voltage overshoot that could otherwise result in charge over-transfer. An excessive delay or number of voltage ramp steps could result in an undesirable charge under-transfer condition at the top of the print medium 130.

Preferably, the above technique is used only when the through print-medium transfer voltage falls below a print threshold PTV of +655 volts or less, which is indicative of humid conditions. Each voltage step is fixed at 100 volts (four PWM steps) of 30 millisecond duration. When the IP transfer voltage is at 0 volts, a maximum of seven, four-PWM step increments could be required to complete the transition from a 0 volts IP to +655 volts TPM. It will be understood that although a threshold PTV of +655 volts is indicative of leading edge over-transfer conditions for EP printers, such as the Lexmark® Optra® laser printer, with the photoconductor core biased at −200 volts, the ramped transition voltage threshold PTV may vary for different printers, power supplies, transfer members, photoconductors, and print media.

Referring to FIG. 3, in order to prevent charge over-transfer throughout the remainder of print medium 130 during printing, processor 114 is programmed to control a charge erase device 142 positioned adjacent the photoconductor 122 by turning on erase device 142 when the transfer servo voltage drops below a pre-determined servo threshold voltage (STV). The servo threshold STV will vary depending on the process speed of the printer. For example, for a Lexmark® Optra® laser printer operating at a speed of 16 pages per minute, the charge erase device 142 is turned on when the transfer servo voltage falls below a STV servo threshold of +300 volts. At 12 pages per minute, the erase device 142 is turned on at a STV servo threshold of +400 volts, and at 8 pages per minute the erase device 142 is turned on at a STV servo threshold of +500 volts.

Preferably, charge erase device 142 includes a plurality of pre-transfer erase lamps which are already a part of many EP printers, including the Lexmark® Optra® printer, and is therefore preferred over other types of discharge devices. The primary purpose of erase device 142 is to discharge photoconductor 122 to a controlled discharge level during the servo operation. This partial discharge of photoconductor 122 results in a more stable transfer roll voltage over the life of a toner cartridge.

Under conditions not conducive to charge over-transfer, pre-transfer erase lamps 142 are not used during priming so as to avoid performance disadvantages associated with continuous use over the life of the toner cartridge. Continuous use of the pre-erase lamps 142 increases photoconductor fatigue and reduces the useful life of the photoconductor. Another disadvantage is that continuous use of pre-transfer erase lamps 142 results in increased background toner on the print for a print cartridge that is nearing the end of its useful life. To address these concerns, pre-transfer erase lamps 142 are turned on by the processor 114 only when the transfer servo voltage is below the process-speed dependent servo threshold voltage STV described above.

The pre-transfer erase lamps 142, which consist of a bank of ten light emitting diodes, produce radiant energy that discharges the photoconductor 122 to an intermediate voltage level so that the difference in electrical potential between image and non-image areas of the developed image is reduced. This both reduces the overall current delivered by power supply 112 and reduces the magnitude of current transients between white and black bands. As a result, power supply 112 enters a current limiting mode infrequently. This minimizes the occurrence of the current mode to voltage mode transition and resultant voltage overshoot, thereby preventing intra-page charge over-transfer problems on print medium 130. Adequate transfer current is delivered to image areas under humid conditions without over-transfer when both transfer member 128 and print medium 130 are low in resistance. Erase lamp intensity may be varied as necessary for various print medium types and for simplex vs. duplex (second pass) printing. Media type and thickness will affect the amount of attenuation of radiant energy from erase lamps 142.

Figure 6:
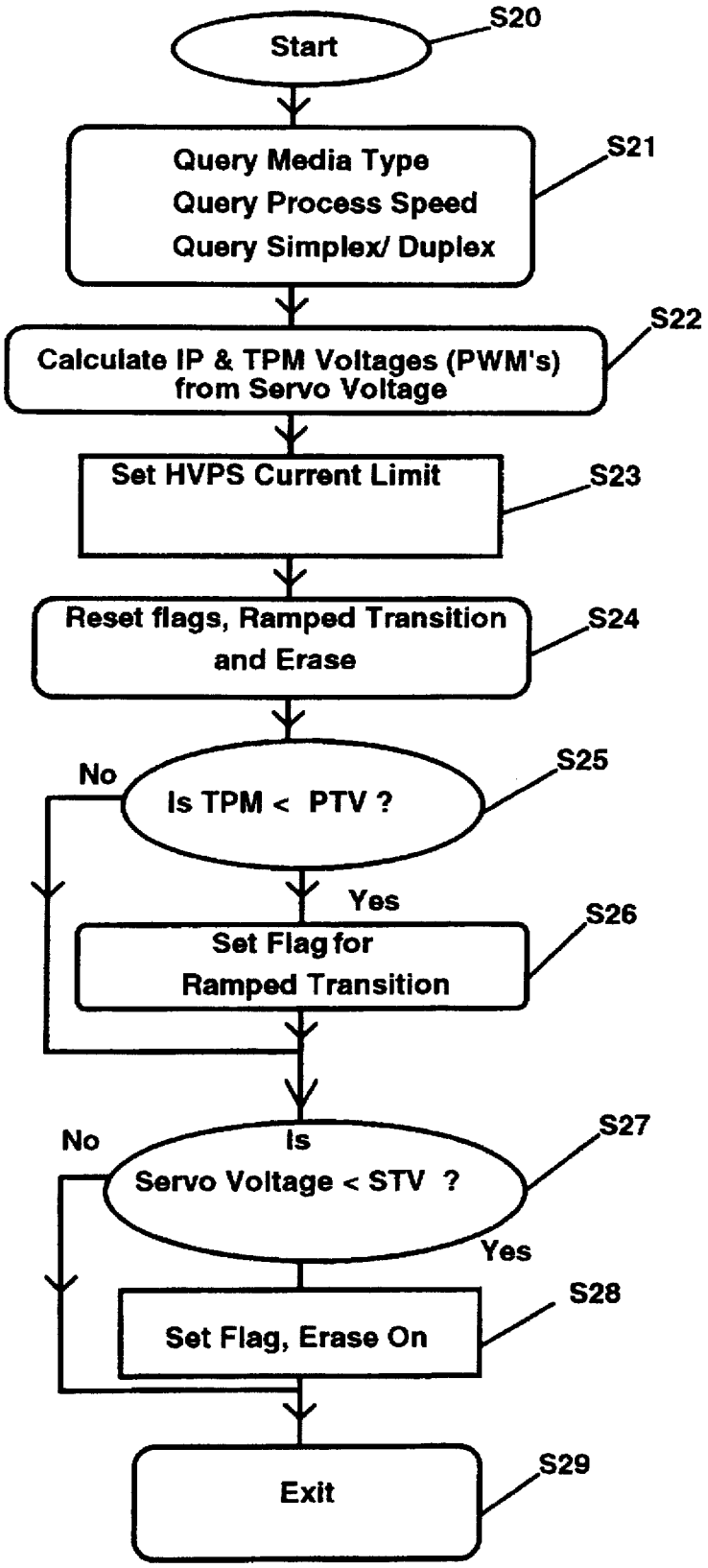
FIG. 6 is a flow chart describing the process used to determine the need for over-transfer correction and to enable the correction means.

FIG. 6 shows a flow chart of a preferred process used to activate the ramped turn-on correction for leading edge charge over-transfer and the pre-transfer erase correction for intra-page charge over-transfer. Step S20 in FIG. 6 is the entry point. In step S21 the processor accesses media type, process speed, and simplex/duplex mode information from status registers. In step S22, this media and mode information is used in conjunction with the transfer servo voltage to calculate the inter-page and through print-medium transfer voltage for the next print. For example, for a process speed of 8.4 cm per second, simplex printing, and 20# xerographic paper, when the transfer servo voltage (Vservo) is +400 volts, the calculation for the TPM voltage is: TPM=1.61×Vservo−100V=+544 volts. The calculation for the IP voltage is: IP =0.2×Vservo=+80 volts. In step S23 the transfer high voltage power supply (HVPS) current limit is determined from the medium and mode information and sent via control line 146 to power supply 112. In step S24, the flags for ramped transition and erase on are reset to a known off state, disabling the two charge over-transfer corrections. In step S25, the TPM voltage calculated in step S22 is compared to the print threshold voltage PTV. If the TPM level is less than +655 volts, the flag to enable ramped turn on at the leading edge of the page is enabled in step S26; otherwise, the negative result bypasses step S26, leaving the ramped transition flag reset and ramped turn on disabled. In step S27, the transfer servo voltage is compared to the servo threshold voltage STV. If the transfer servo voltage is less than the servo threshold STV, which is a function of process speed, then the flag to enable pre-transfer erase during print is enabled. If the result of the comparison is negative, step S28 is bypassed, the pre-transfer erase flag is left reset, and pre-transfer erase is left disabled. The process of setting flags for over-transfer correction is concluded in step 29.

Figure 7A:
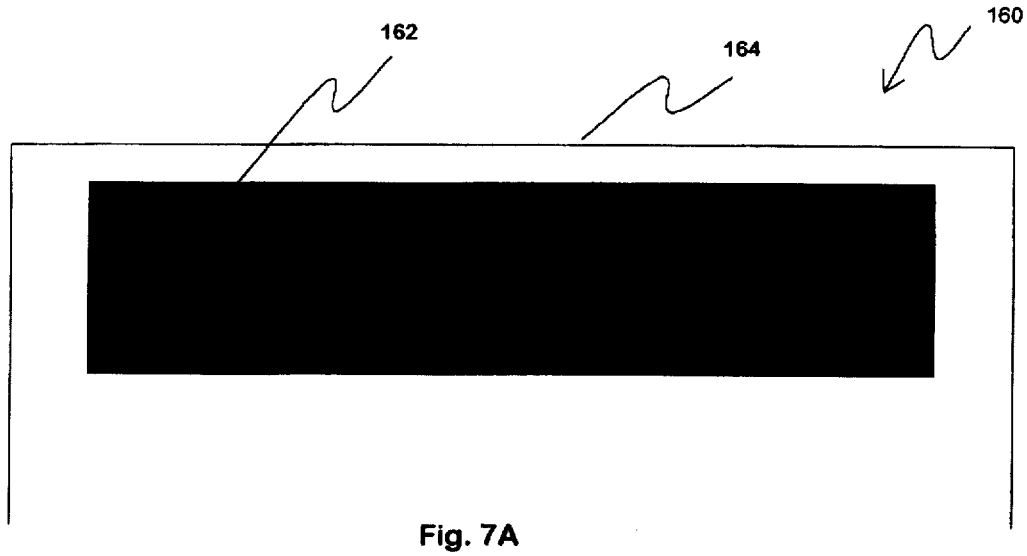
FIG. 7A illustrates improved toner transfer for a printed page resulting from employing the leading edge correction aspect of the invention.
Figure 8A:
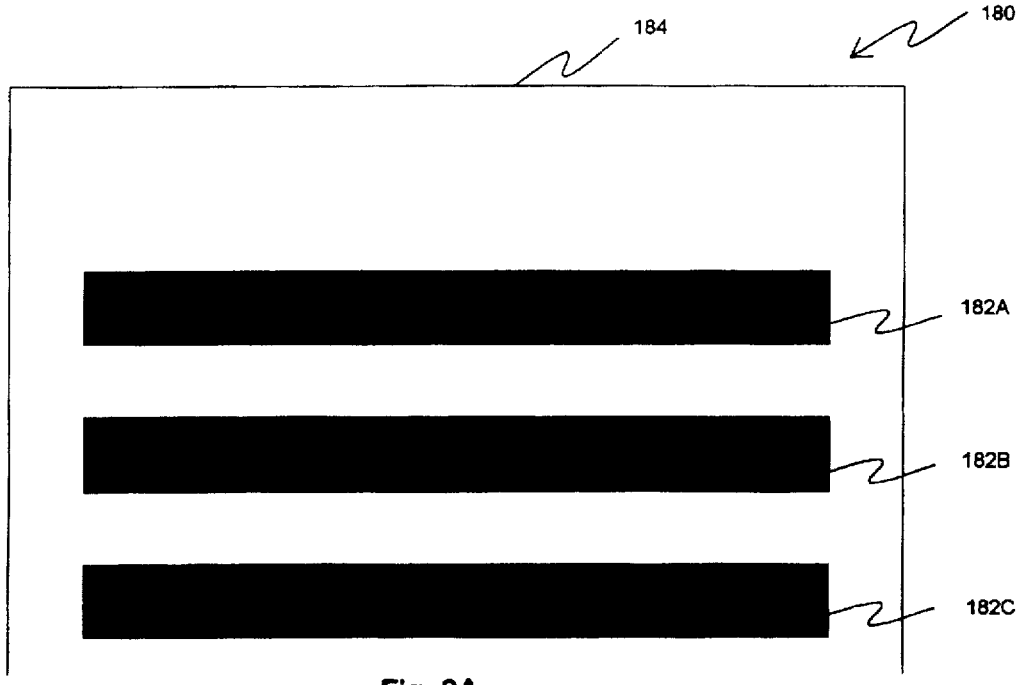
FIG. 8A illustrates improved intra-page toner transfer for a printed page resulting from employing the intra-page correction aspect of the present invention.

FIGS. 7A and 8A illustrate the improved printing results achieved by inhibiting toner transfer defect/charge over-transfer conditions, under 78 degree F./80% relative humidity conditions, in comparison to the print results shown in FIGS. 1A and 2A.

Figure 7B:
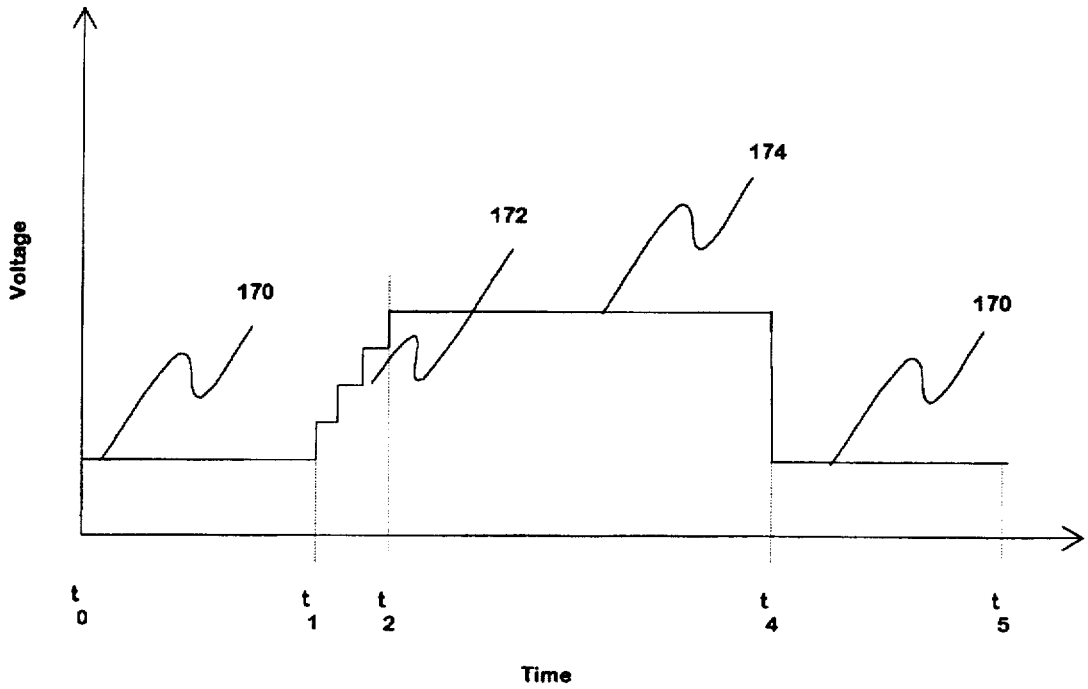
FIG. 7B graphically depicts the applied transfer roll voltage which resulted in the printed page of FIG. 7A.

As shown in FIG. 7A, a print medium 160 printed using the invention includes a solid black patch 162 located near leading edge 164. By comparing FIG. 1A to FIG. 7A, it is apparent that the toner transfer defect of FIG. 1A is absent from black patch 162 of FIG. 7A. Referring to FIG. 7B, the charge over-transfer condition is eliminated by stepping the voltage 172 during time $t_1$ to $t_2$ from IP level 170 to TPM level 174 in the manner described above. After printing on sheet 160 is complete, the voltage is again reduced to IP level 170 at time $t_4$. When necessary, this process is repeated for the printing at the beginning of each page. Note that the relative times shown in FIG. 7B generally correspond to the relative times shown in FIG. 1B that share the same alphanumeric descriptor, except that time interval $t_1$ to $t_2$ of FIG. 7B may be longer than time interval $t_1$ to $t_2$ of FIG. 1B.

Figure 8B:
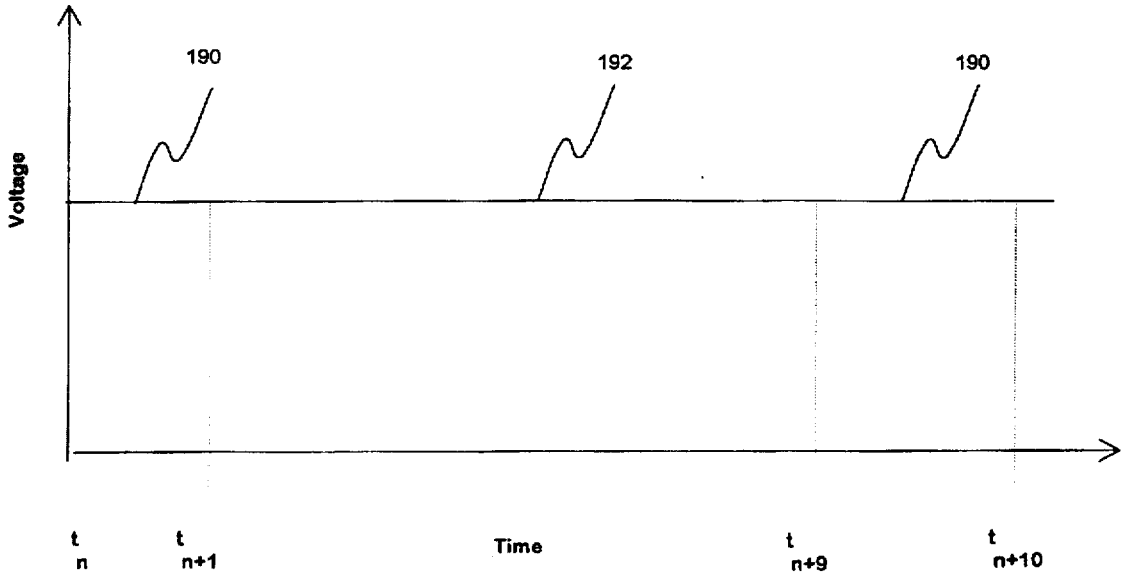
FIG. 8B graphically depicts the applied transfer roll voltage which resulted in the printed page of FIG. 8A.

As shown in FIG. 8A, a print medium 180 includes a plurality of print regions 182 (identified individually as 182A–182C) formed well down the page from a leading edge 184 during intra-page printing. By comparing FIG. 2A to FIG. 8A, it is apparent that the toner transfer defect regions 36A–36C of FIG. 2A are absent from black patch regions 182 of FIG. 8A. FIG. 8B shows the voltage profile when erase lamps are turned on in regions 190 and 192 in accordance with the intra-page process described above. Time $t_{n+1}$ represents the start of toner transfer to print medium 180 at the leading edge of black patch 182A and time $t_{n+9}$ represents the end of toner transfer to print medium 180 at the trailing edge of black patch 182C. By comparing FIGS. 2A and 2B to FIGS. 8A and 8B, respectively, it is apparent that voltages spikes 42A, 42B, 42C of FIG. 2B associated with toner defect regions 36A, 36B, and 36C of FIG. 2A are absent from the voltage profile of FIG. 8B which resulted in the solid black patches of FIG. 8A. It should be noted that the TPM voltage 192 is substantially constant throughout black patch/white patch transitions shown in FIG. 8A. Also, it should be noted that the relative times shown in FIG. 8B generally correspond to the relative times shown in FIG. 2B that share the same alphanumeric descriptor.

Although the present invention has been described with reference to preferred embodiments, those skilled in the art will recognize that changes may be made in form and detail without departing from the spirit and scope of the following claims.

What is claimed is:

1. A method for inhibiting over-transfer of electrical charge through a transfer medium to a toner after development of a latent image on a photoconductor in an electrophotographic imaging device, comprising the steps of identifying a condition conducive to over-transfer of electrical charge through said transfer medium; and, upon identifying said condition, selectively providing a controlled ramped voltage output to a transfer member so as to provide a controlled flow of charge from said transfer member to said transfer medium during an initial application of electrical charge to a first region of said transfer medium adjacent a leading edge of said transfer medium.

2. The method of claim 1, wherein the step of providing a controlled ramped voltage output comprises providing a stepped voltage increase from a first predetermined voltage to a second predetermined voltage.

3. The method of claim 2, wherein said first predetermined voltage corresponds to an inter-page voltage which is applied to said transfer member when said transfer medium has not yet entered a nip region between said photoconductor and said transfer member.

4. The method of claim 2, wherein said second predetermined voltage corresponds to a media present voltage to be applied to said transfer member when a leading edge of said transfer medium is adjacent a nip region between said photoconductor and said transfer member.

5. The method of claim 2, wherein said first predetermined voltage and said second predetermined voltage are determined based upon a measured voltage corresponding to a predetermined current flow between said photoconductor and said transfer member when said transfer medium has not yet entered a nip region between said photoconductor and said transfer member.

6. A method for inhibiting over-transfer of electrical charge through a transfer medium to a toner after development of a latent image on a photoconductor in an electrophotographic imaging device, comprising the steps of:

providing a controlled ramped voltage output to a transfer member so as to provide a controlled/flow of charge from said transfer member to said transfer medium during an initial application of electrical charge to a first region of said transfer medium adjacent a leading edge of said transfer medium;

measuring a servo voltage corresponding to a predetermined current flow between said photoconductor and said transfer member when said transfer medium is not present in a nip region between said photoconductor and said transfer member;

selecting a servo threshold voltage corresponding to a voltage level below which an over-transfer of said electrical charge through said transfer medium to said toner occurs; and selectively activating a light source when said transfer medium is present in said nip region so as to partially discharge a portion of said photoconductor when said servo voltage is below said servo threshold voltage during an image transfer period.

7. The method of claim 6, wherein the step of providing a controlled ramped voltage output comprises providing a stepped voltage increase from a first predetermined voltage to a second predetermined voltage, wherein said first predetermined voltage and said second predetermined voltage are derived from said servo voltage.

8. The method of claim 7, wherein said first predetermined voltage corresponds to an inter-page voltage which is applied to said transfer member when said transfer medium has not yet entered said nip region.

9. The method of claim 7, wherein said second predetermined voltage corresponds to a media present voltage to be applied to said transfer member when a leading edge of said transfer medium is adjacent said nip region.

10. A method for inhibiting over-transfer of electrical charge through a transfer medium to a toner after development of a latent image on a photoconductor in an electrophotographic imaging device, comprising the steps of:

providing a controlled ramped voltage output to a transfer member so as to provide a controlled flow of charge from said transfer member to said transfer medium during an initial application of electrical charge to a first region of said transfer medium adjacent a leading edge of said transfer medium, thereby providing a voltage increase from a first predetermined voltage to a second predetermined voltage;

selecting a print threshold voltage corresponding to a voltage level below which an over-transfer of said electrical charge through said transfer medium to said toner occurs; and selectively performing said step of providing a controlled ramped voltage only when said second predetermined voltage is below said print threshold voltage.

11. A method for inhibiting over-transfer of electrical charge through a transfer medium to a toner after development of a latent image on a photoconductor in an electrophotographic imaging device, comprising the steps of:

a) measuring a servo voltage corresponding to a predetermined current flow between said photoconductor and a transfer member when said transfer medium is not present in a nip region between said photoconductor and said transfer member;

b) selecting a servo threshold voltage corresponding to a voltage level below which an over-transfer of said electrical charge through said transfer medium to said toner occurs; and c) selectively activating a light source when said transfer medium is present in said nip region so as to partially discharge a portion of said photoconductor when said servo voltage is below said servo threshold voltage during an image transfer period.

12. The method of claim 11, further comprising the step of providing a controlled ramped voltage output to said transfer member so as to provide a controlled flow of charge from said transfer member to said transfer medium during an initial application of electrical charge to a first region of said transfer medium adjacent a leading edge of said transfer medium.

13. The method of claim 12, wherein the step of providing a controlled ramped voltage output comprises providing a stepped voltage increase from a first predetermined voltage to a second predetermined voltage, wherein said first predetermined voltage and said second predetermined voltage are derived from said servo voltage.

14. The method of claim 13, wherein said first predetermined voltage corresponds to an inter-page voltage which is applied to said transfer member when said transfer medium has not yet entered said nip region.

15. The method of claim 13, wherein said second predetermined voltage corresponds to a media present voltage to be applied to said transfer member when a leading edge of said transfer medium is adjacent said nip region.

16. A method for inhibiting over-transfer of electrical charge through a transfer medium to a toner after development of a latent image on a photoconductor in an electrophotographic imaging device, comprising the steps of:

a) selecting a print threshold voltage corresponding to a first voltage level below which an over-transfer of said electrical charge through said transfer medium to said toner occurs;

b) selecting a servo threshold voltage corresponding to a second voltage level below which an over-transfer of said electrical charge through said transfer medium to said toner occurs;

c) measuring a servo voltage corresponding to a predetermined current flow between said photoconductor and a transfer member when said transfer medium is not present in a nip region between said photoconductor and a transfer member;

d) deriving from said servo voltage a media present voltage to be applied to said transfer member when said transfer medium has entered said nip region;

e) comparing said media present voltage with said print threshold voltage;

f) applying a controlled ramped voltage output to said transfer member during an initial application of electrical charge to a first region of said transfer medium adjacent a leading edge of said transfer medium when said media present voltage is below said print threshold voltage;

g) comparing said servo voltage to said servo threshold voltage; and h) activating a light source prior to an image transfer to said transfer medium to partially discharge a portion of said photoconductor when said servo voltage is below said servo threshold voltage.

* * * * *